United States Patent [19]

Jeanson et al.

[11] 4,358,280

[45] * Nov. 9, 1982

[54] DEVICE FOR ROTATIONALLY DRIVING AND STEERING A SCREW-RUDDER OF A FLOATING VEHICLE

[75] Inventors: Rene H. Jeanson, Auzay, France; Daniel Vagner, Fontenay le Conte, both of France

[73] Assignee: Valeo, Paris, France

[ * ] Notice: The portion of the term of this patent subsequent to Mar. 13, 1996, has been disclaimed.

[21] Appl. No.: 95,600

[22] Filed: Nov. 19, 1979 (Under 37 CFR 1.47)

Related U.S. Application Data

[63] Continuation of Ser. No. 865,603, Dec. 29, 1977, abandoned.

[30] Foreign Application Priority Data

Jan. 7, 1977 [FR] France ..... 77 00308

[51] Int. Cl.[3] ..... B63H 5/12

[52] U.S. Cl. ..... 440/61; 440/4; 440/5

[58] Field of Search ..... 115/34 R, 34 A, 35, 115/41 R, 41 HT, 18 R; 114/144 R, 144 A; 74/645, 661, 29, 30; 440/5, 53, 54, 61

[56] References Cited

U.S. PATENT DOCUMENTS

| | | | |
|---|---|---|---|
| 2,749,874 | 6/1956 | Klatte | 115/34 A |
| 3,203,390 | 8/1965 | Boda | 115/18 R |
| 3,576,106 | 4/1971 | Nowicki | 74/661 |
| 3,599,595 | 8/1971 | James | 115/34 A |
| 3,673,978 | 7/1972 | Jeffery et al. | 115/34 A |
| 3,847,107 | 11/1974 | Buddrus | 115/35 |
| 3,896,757 | 7/1975 | Kucher | 115/41 R |
| 3,915,111 | 10/1975 | Buddrus | 115/41 HT |

*Primary Examiner*—Sherman D. Basinger
*Assistant Examiner*—Jesús D. Sotelo
*Attorney, Agent, or Firm*—Young & Thompson

[57] ABSTRACT

The screw of a screw-rudder propulsion assembly for a floating vehicle is suspended on the end of a steering shaft which is housed in a tubular casing which is supported on the vehicle. The shaft is rotated to steer the vehicle and the screw is driven by a hydrostatic receiver unit housed in the screw-rubber assembly. A pair of rotating joints through which oil is circulated to the hydrostatic receiver unit, a trust bearing, and the steering drive for rotating the steering shaft are grouped together at the top of the shaft.

5 Claims, 10 Drawing Figures

DEVICE FOR ROTATIONALLY DRIVING AND STEERING A SCREW-RUDDER OF A FLOATING VEHICLE

This is a continuation, of application Ser. No. 865,603, filed Dec. 29, 1977, now abandoned.

BACKGROUND OF THE INVENTION

1. Field of the Invention

This invention relates to a device for rotationally driving and steering a screw-rudder for a floating vehicle.

2. Description of the Prior Art

The device is of the kind comprising a support for mounting on a floating vehicle, a tubular casing mounted on the support, a steering shaft steerably mounted in the tubular casing and supported by the casing with the aid of thrust bearing means, a screw-carrier assembly suspended rigidly on the steering shaft, first drive means for rotationally driving the screw for propelling the vehicle, and second drive means for rotating of the steering shaft for altering the course steered by the said vehicle.

SUMMARY OF THE INVENTION

The main object of the invention is to provide a driving device of this kind, in which the means for driving the screw comprises at least one hydrostatic receiver unit housed in the screw-carrier assembly and connected to a hydrostatic transmitter unit by a pair of oil circulation pipes which are adapted to the steerable mounting of the steering shaft in the tubular casing and take into account the second drive means for rotating the steering shaft, which arrangement is a simple, robust, and compact construction which permits the transmission of high power.

According to the invention a device for rotationally driving and steering a screw-rudder of a floating vehicle, of the type referred to above has a pair of oil circulation pipes which comprise a pair of ducts in the interior of the steering shaft and a pair of rotating joints interposed between the steering shaft and the tubular casing. The rotating joints, the drive means for rotating the steering shaft, and thrust bearing means which support the steering shaft in the casing are grouped together at the top end of the steering shaft.

As the result of this arrangement the oil circulation ducts can have a large cross-section which permits the transmission of high power.

The drive means for rotating the steering shaft preferably comprises a rack meshing with a toothed end of the steering shaft which constitutes a pinion which is disposed immediately above the pair of rotating joints, which themselves are disposed immediately above the thrust bearing means.

The construction is simple, robust and compact, permitting excellent operation. The diameters of the tubular casing and of the steering shaft may be relatively small. In particular a very small diameter may be selected with advantage for the pinion driven by the rack at the top of the steering shaft.

In one embodiment the hydrostatic receiver unit housed in the screw-carrier assembly is coaxial to and directly connected to the screw, while in another embodiment the hydrostatic receiver unit and the screw have their axes parallel and spaced apart and the hydrostatic receiver unit drives the screw through gear means.

In yet another embodiment at least two hydrostatic receiver units are provided, these units and the screw have their axes parallel and spaced apart, and the units drive the screw through planet gears and a ring gear.

The screw carrier assembly is preferably provided with a domed water guide cowling disposed upstream of the screw. The hydrostatic receiver unit or units is/are advantageously housed in this cowling.

When a plurality of hydrostatic receiver units are provided, it is preferable to use a ready-made cowling incorporating assembly means for the hydrostatic receiver units and parts of the oil circulation ducts which connect these units to the ducts in the steering shaft, this arrangement being provided with a fairing for the cowling and transmission and bearing means.

BRIEF DESCRIPTION OF THE DRAWINGS

Some embodiments of the invention will now be described, by way of example, with reference to the accompanying drawings, in which.

DESCRIPTION OF THE PREFERRED EMBODIMENTS

The embodiment illustrated in FIGS. 1 to 7 is a device rotationally driving and steering a screw-rudder and can be used on floating vehicles of all kinds, such as boats, ships, barges, dinghies, pontoons, submerisible craft or amphibious vehicles.

Figure 1:
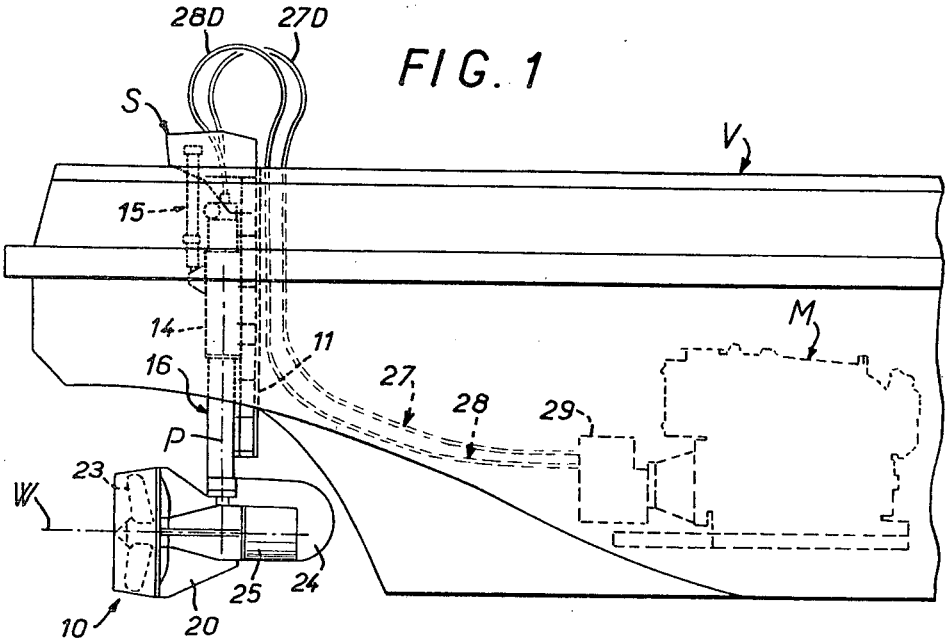
FIG. 1 is a general view of the rear of a floating vehicle and shows diagrammatically a device according to the invention for rotationally driving and steering a screw-rudder assembly.
Figure 3:
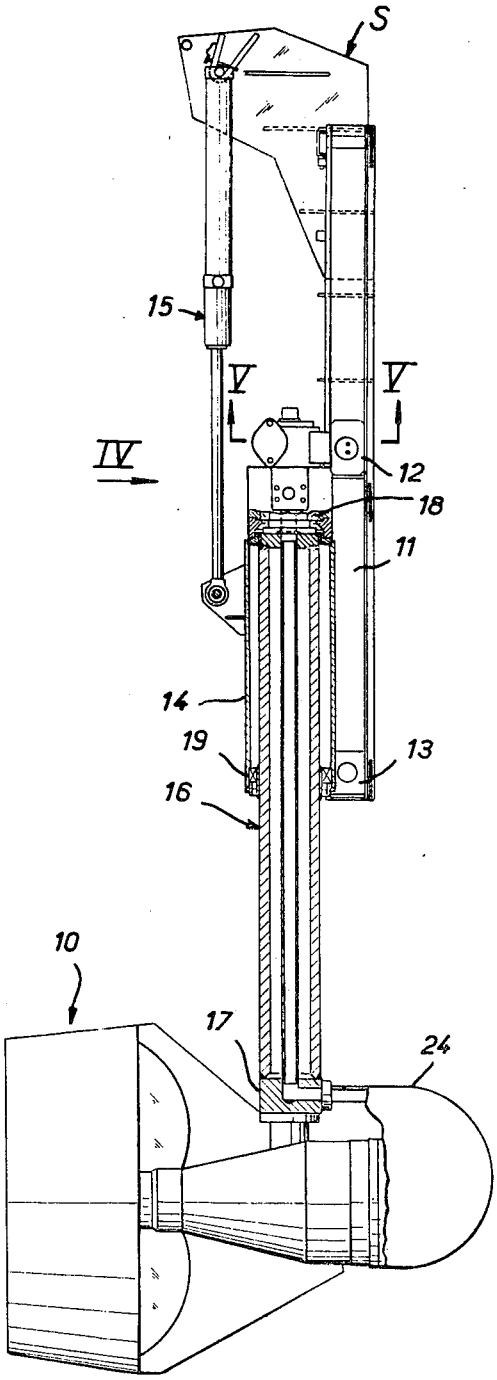
FIG. 3 is an elevation, partly in section on the line III—III in FIG. 4 of the mounting of the screw-carrier assembly on a steering shaft, of housing of the steering shaft in a tubular casing, and of the mounting of the tubular casing on a support.
Figure 4:
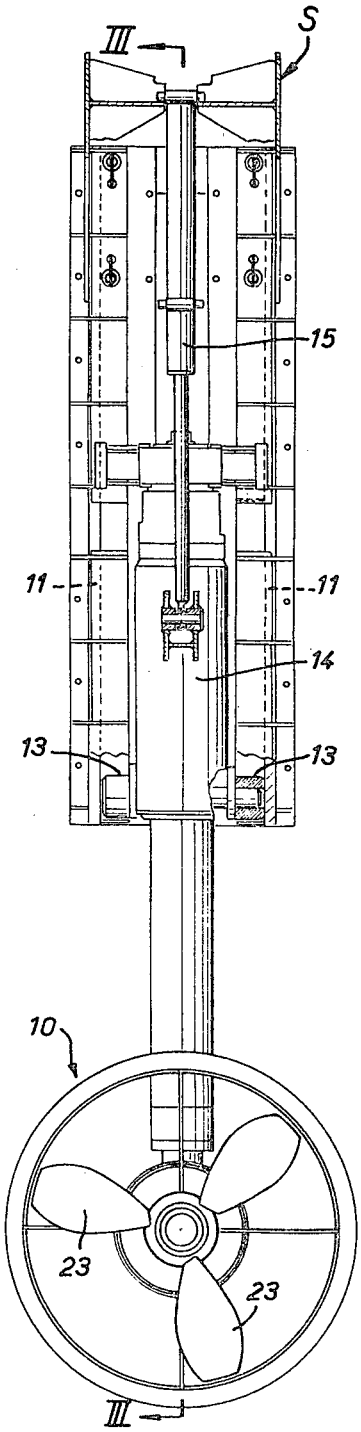
FIG. 4 is a corresponding view of the device in elevation in the direction of the arrow IV in FIG. 3.

A floating vehicle V, FIG. 1, comprises at the rear a chassis C, FIGS. 1, 3 and 4, of any suitable shape, for mounting a bulb-shaped screw-rudder or steerable propeller assembly 10.

On the chassis C, is fixed a support S having vertical slide guides 11 which receive slide shoes 12 and 13. A tubular casing 14 is mounted for sliding on the slide guide 11 by means of the shoes 12 and 13. A power cylinder 15 acting between the support S and the tubular casing 14 slides the casing 14 for adjusting the depth of the screw-rudder 10.

In addition, the tubular casing 14 can be raised in order to bring the screw-rudder 10 out of the water for inspection and repair. For this purpose the tubular casing 14 is pivotable about the upper shoes 12 by the power cylinder 15, the lower shoes 13 being adapted to move out of the slide guides 11. See also U.S. Pat. No. 4,143,614, for a further showing of this structure.

In the tubular casing 14 there is mounted a downwardly extending steering shaft 16 to the lower end 17 of which the bulb-shaped assembly 10 is rigidly connected.

Figure 6:
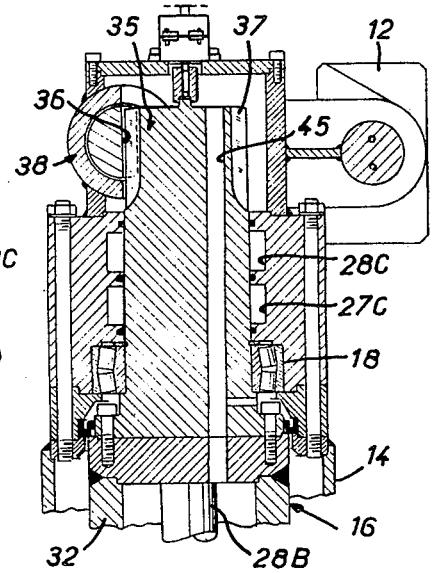

The steering shaft 16 is centered and supported by the tubular casing 14 by means of a thrust bearing 18, FIGS. 3 and 6 at the top of the shaft 16, and a centering bearing 19 at the bottom of the casing 14, (FIG. 3).

The bulb-shaped assembly 10 comprises a frame 20 which is fastened to the bottom end 17 of the shaft 16 and is provided with bearings 21. A rotatable shaft 22 is mounted in the bearings 21 and carries a screw 23 disposed at the rear of the bulb-shaped assembly 10. The assembly 10 also includes a domed water guide cowling 24 mounted upstream of the screw 23.

A first drive means is provided for the rotational driving of the screw 23 to propel the vehicle V.

Figure 2:
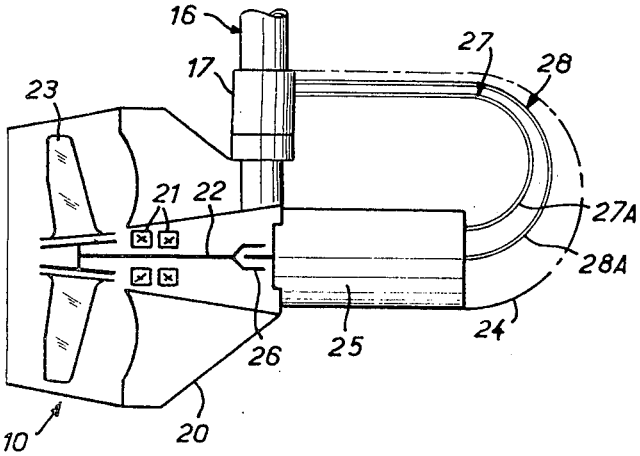
FIG. 2 is a diagrammatic view on a larger scale of the screw-carrier assembly with a water guide cowling incorporating a hydrostatic receiver unit.

The first drive means comprises, FIG. 2, a hydrostatic receiver unit 25 housed in the water guide fairing 24 of the assembly 10. The hydrostatic receiver unit 25 is coaxial with the screw 23 and is directly coupled with the screw by means of a splined connection 26.

The hydrostatic receiver unit 25 is connected by a pair of oil circulation pipes 27 and 28 to a hydrostatic transmitter unit 29 housed on board the vehicle V and driven by an engine M, for example a diesel engine.

Figure 7:
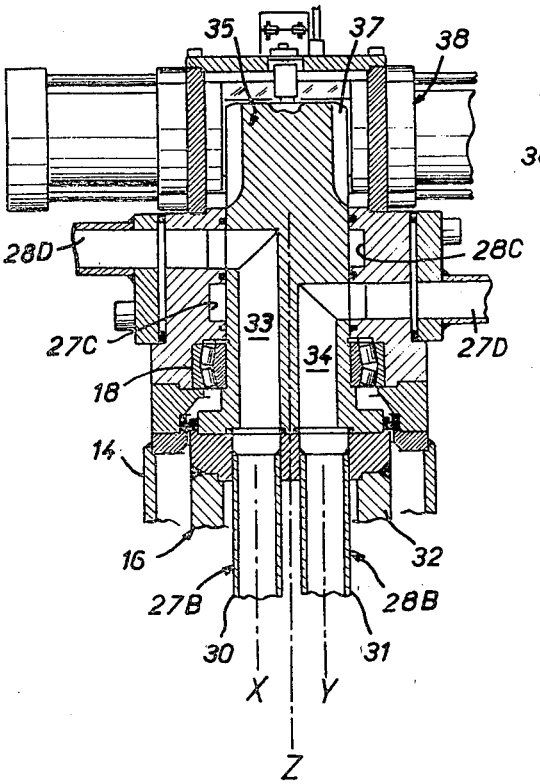
FIGS. 6 and 7 are views of the top end of the steering shaft in vertical sections on the lines VI—VI and VII—VII respectively in FIG. 5.

The pair of pipes 27 and 28 comprises portions 27A and 28A, FIG. 2, disposed in the bulb-shaped assembly 10; portions 27B and 28B, FIG. 7, consisting of ducts provided inside the steering shaft 16; rotating joints 27C and 28C, FIG. 7, interposed between the steering shaft 16 and the tubular casing 14; and portions 27D and 28D, FIGS. 1 and 7, which extend between the tubular casing 14 and the hydrostatic transmitter unit 29 and which are at least partly deformable, for example flexible or articulated, in order to be adjustable to both sliding and pivoting displacement of the tubular casing 14 relative to the support S.

Figure 5:
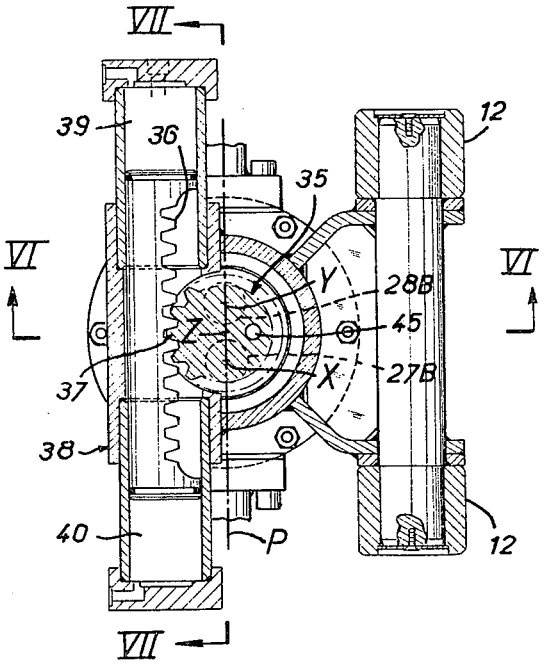
FIG. 5 is a view on a larger scale of the top end of the steering shaft, in a horizontal section on the line V—V in FIG. 3.

The axes X and Y of the ducts 27B and 28B inside the steering shaft 16, FIG. 5, extend parallel to and on each side of the axis Z of the steering shaft 16. The plane P, FIGS. 1 and 5, defined by the axes X, Y, Z is perpendicular to the axis W of the screw 23, FIG. 1. The plane P constitutes a neutral diametrical plane of the shaft 16 when the shaft 16 flexes during operation.

In the embodiment illustrated the ducts 27B and 28B, FIG. 7 comprise tubes 30 and 31 housed inside the shaft 16, which is hollow over the major portion 32 of its length, and bores 33 and 34 in the upper end 35 of the shaft 16, which is solid. The ducts 27B and 28B have a large diameter, thus enabling high power transmission.

The rotating joints 27C and 28C, FIGS. 6 and 7, consist of annular grooves provided one above the other in the tubular casing 14 and surrounding the solid upper portion of the shaft 16, in such a manner as to be in permanent communication with the bores 33 and 34. The grooves 27C and 28C are connected respectively to the portions 27D and 28D of the pipes 27 and 28.

A second drive means is provided for varying the orientation of the steering shaft 16 in the tubular casing 14 for altering the course steered by the vehicle V.

The second drive means, FIGS. 5 and 6, comprises a rack 36 meshing with a toothed end 37 of the top solid portion 35 of the shaft 16, which forms a pinion. The rack 36 is driven hydraulically and is formed by a plunger piston engaged slidingly in a cylinder 38. Hydraulic chambers 39 and 40 are provided in the cylinder 38 on each side of the piston 36 for operating the piston.

As can be seen in FIG. 6, the rotating joints 27C and 28C, the second drive means 36, 37, and the thrust bearing 18 are grouped together in a compact arrangement at the top end 35 of the steering shaft 16.

The pinion 37 is disposed immediately above the grooves 27C and 28C, which are disposed immediately above the thrust bearing 18.

The diameter of the pinion 37 may be selected so as to be as small as desired having regard to the position which it occupies.

An oil leakage collector duct 45 is shown in FIG. 6.

During operation the motor M drives the hydrostatic transmitter unit 29, which by circulation of oil through the pipes 27 and 28 drives the hydrostatic receiver unit 25, which drives the screw 23 and thus propels the vehicle V. In order to change the course steered, the hydraulic chambers 39 and 40 are acted on so as to cause the rack 36 to slide and the shaft 16 carrying the assembly 10 to turn.

In the embodiment which has just been described with reference to FIGS. 1 to 7 the hydrostatic receiver unit 25 is coaxial with and directly coupled to the screw 23.

Figure 8:
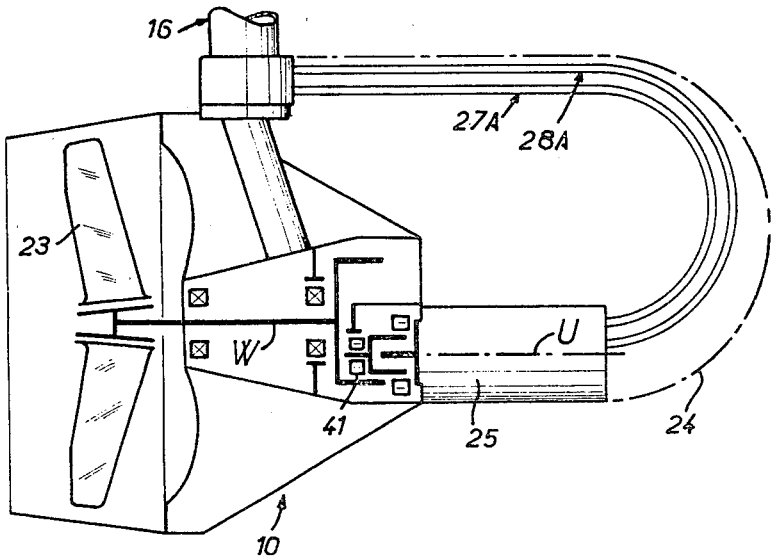
FIGS. 8, 9 and 10 are views similar to FIG. 2 of three more embodiments of the screw-carrier assembly.

An alternative is illustrated in FIG. 8. The hydrostatic receiver unit 25 and the screw 23 have their axes U and W parallel and spaced apart. The unit 25 is housed in the fairing 24 and drives the screw 23 through a gear train 41.

Figure 9:
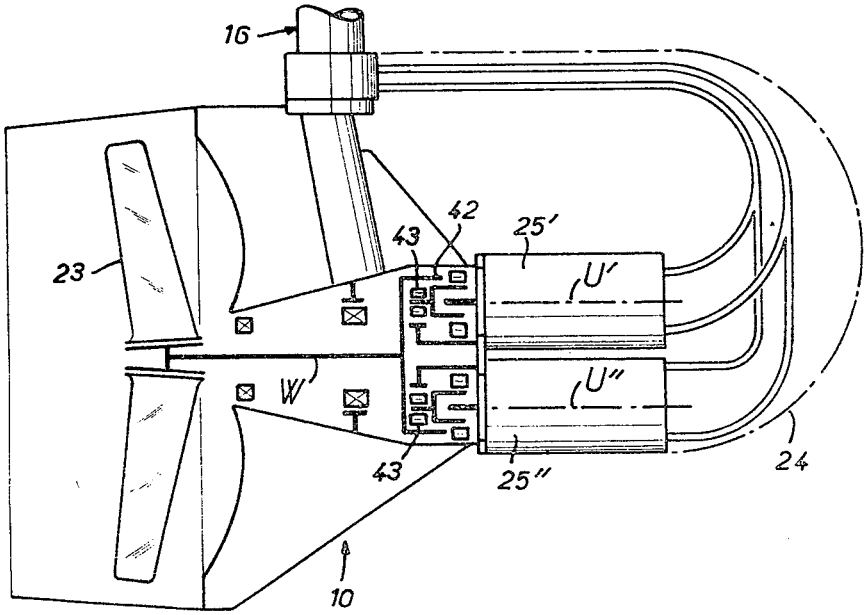

In another embodiment, illustrated in FIG. 9, at least two hydrostatic units 25' and 25'' are provided, and are housed in the cowling 24. The axes U' and U'' of the units 25' and 25'' and the axis W of the screw 23 are parallel and spaced apart. The units 25' and 25'' drive the screw 23 through planet gears 43 and a ring gear 42.

Figure 10:
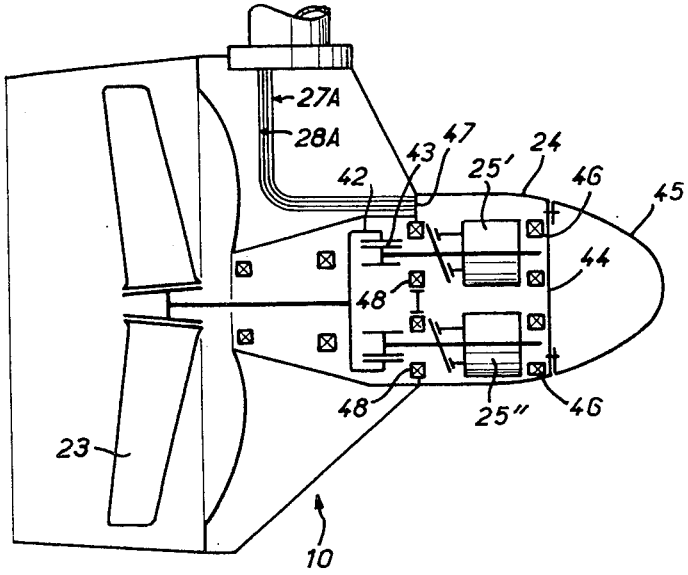

It is sometimes advantageous to provide a prefabricated form of cowling 24 as shown in FIG. 10, in which the portions 27A and 28A of the pipes 27 and 28 are provided in the form of passages, a rear fairing 45 is provided which has a partition 44 adapted to receive bearings 46 for the hydrostatic units 25' and 25'', and another partition 47 is adapted to receive bearings 48 for the units 25' and 25'', as well as the ring gear 42.

All that is then required is to install the rotating parts, that is to say the units 25' and 25'' and pinions 43.

We claim:

1. In a device for rotationally driving and steering a screw-rudder of a floating vehicle, comprising:

a support for mounting on a floating vehicle;

a tubular casing mounted on the support;

a steering shaft which is mounted for rotation in the tubular casing;

thrust bearing means supporting the steering shaft in the tubular casing;

a screw-carrier assembly rigidly suspended from the steering shaft;

first drive means for rotationally driving a screw carried by said screw-carrier assembly and including at least one hydrostatic receiver unit housed in the screw-carrier assembly, a hydrostatic transmitter unit, and a pair of oil circulation pipes connecting the hydrostatic receiver unit to the hydrostatic transmitter unit; and second drive means disposed at the top end of the steering shaft for rotating the steering shaft in the tubular casing in order to steer the screw-rudder; and wherein said pair of oil circulation pipes comprises a pair of ducts inside the steering shaft and a pair of rotating joints interposed between the steering shaft and the tubular casing; said pair of rotating joints and said thrust bearing means being grouped together with said second drive means at the top end of the steering shaft; the improvement in which said pair of rotating joints is disposed immediately below said second drive means, said pair of rotating joints is disposed immediately above said thrust bearing means, centering bearing means supporting the steering shaft in the tubular casing at the bottom end of the tubular casing, said pair of rotating joints comprising a pair of superposed annular recesses in said casing, said second drive means comprising a pinion on said shaft, a rack engageable with said pinion, means to reciprocate said rack to rotate said shaft, said thrust bearing means comprising inner and outer races with anti-friction means therebetween, substantially vertical slide guide means fastened to the support, top and bottom slide shoe means slidable in said slide guide means, said tubular casing being mounted on said bottom slide shoe means and being pivotally mounted on said top slide shoe means, and means acting between said casing and said support to raise and lower said casing, said bottom slide shoe means being adapted to move out of said slide guide means to permit the casing to pivot about said top slide shoe means thereby to lift the screw-carrier assembly out of the water.

2. A device according to claim 1, wherein said hydrostatic receiver unit has a driving axis which is parallel to the axis of a screw in the screw-carrier assembly, said axes are spaced apart, and gear means connected the hydrostatic receiver unit to the screw.

3. A device according to claim 1, comprising at least two said hydrostatic receiver units housed in the screw-carrier assembly, which units have parallel driving axes which are parallel to the axis of a screw in the screw-carrier assembly, which axes are spaced apart, and planet gears and a ring gear connecting the hydrostatic receiver units to the screw.

4. A device according to claim 3, wherein the screw-carrier assembly has a dome-shaped water guide cowling disposed upstream of the screw and the hydrostatic receiver units are housed in the cowling.

5. A device according to claim 4, wherein the cowling is prefabricated with connection means for the hydrostatic receiver units and parts of said pipes for connecting said units to said ducts inside the steering shaft.

* * * * *